US005173242A

United States Patent [19]

Lührsen et al.

[11] Patent Number: 5,173,242

[45] Date of Patent: Dec. 22, 1992

[54] MEANS AND METHOD FOR FORMING A SEALED CONNECTION

[75] Inventors: Ernst Lührsen, Bad Schwalbach; Ulrich Schneider, Lauf, both of Fed. Rep. of Germany

[73] Assignee: Didier-Werke AG, Wiesbaden, Fed. Rep. of Germany

[21] Appl. No.: 738,141

[22] Filed: Jul. 30, 1991

[30] Foreign Application Priority Data

Aug. 2, 1990 [DE] Fed. Rep. of Germany ..... 4024520

[51] Int. Cl.[5] ..... B22D 41/58

[52] U.S. Cl. ..... 266/44; 222/590; 222/603; 222/606; 266/217

[58] Field of Search ..... 266/44, 236, 217, 220; 222/590, 603, 606, 607

[56] References Cited

U.S. PATENT DOCUMENTS 3,651,998 3/1972 Rocher ..... 222/603
5,028,033 7/1991 Morioka et al. ..... 222/603

FOREIGN PATENT DOCUMENTS 3226047 1/1984 Fed. Rep. of Germany .
3620413 12/1987 Fed. Rep. of Germany .

*Primary Examiner*—Scott Kastler
*Attorney, Agent, or Firm*—Wenderoth, Lind & Ponack

[57] ABSTRACT

An assembly includes a discharge member of a metallurgical vessel and a pipe member connected to the discharge member at mutual surfaces thereof defining a seat therebetween. An annular recess is formed in the region of such seat, a seal seals such seat, and gas is supplied to the annular recess. The seal is in the form of a pair of compressible sealing rings positioned between the mutual surfaces of the two members on opposite sides of the annular recess. A pressure indicator is connected to a gas supply line supplying gas to the annular recess to provide an indication of the pressure of gas prevailing in the annular recess, and particularly of changes of such pressure.

32 Claims, 1 Drawing Sheet

MEANS AND METHOD FOR FORMING A SEALED CONNECTION

BACKGROUND OF THE INVENTION

The present invention relates to the formation of a sealed connection between a discharge member, for example a refractory spout, and a pipe member, for example a protective shielding pipe or an immersion nozzle. More specifically, the present invention relates to the formation of such a sealed connection wherein the discharge member and the pipe member are connected at mutual or confronting surfaces defining a seat therebetween, with an annular recess formed in the region of the seat and concentric thereto, a seal sealing such seat and means for supplying gas, for example inert gas, to the annular recess.

A sealed connection of this type is disclosed in German DE 32 26 047. In this known arrangement, the seat is formed by a press fit between the mutual surfaces of the two elements. In such an arrangement, the desired gas tightness cannot be guaranteed. Particularly, if even small particles are present between the elements of the press fit, the gas tightness will be significantly impaired. Furthermore, the press fit results in the protective shielding pipe or the immersion nozzle jamming when the conical discharge is removed and breaking subject to a greater force.

In German DE 36 20 413 there is shown a swellable fibrous mat for nozzle shut off and gas feed lines at metallurgical vessels.

SUMMARY OF THE INVENTION

With the above discussion in mind, it is an object of the present invention to provide an improved means and method for forming a sealed connection of the above character.

It is a more specific object of the present invention to provide an improved assembly including a discharge member of a metallurgical vessel, for example a refractory spout, and a pipe member connected to the discharge member at mutual surfaces thereof defining a seat therebetween, an annular recess being formed in the region of the seat, a seal sealing such seat, and means for supplying gas, for example inert gas, to the annular recess. The seal is provided in the form of a pair of compressible sealing rings positioned between the mutual surfaces on opposite sides of the annular recess. Furthermore, a pressure indicator is connected to the gas supply means, for example gas supply line, to provide an indication of the pressure of the gas in the annular recess.

It is a further object of the present invention to provide a novel sealing assembly to be employed to form a sealed connection between such mutual surfaces.

It is a yet further object of the present invention to provide a novel method of formation of such sealed connection.

The sealing rings of the present invention guarantee the necessary tightness of the seat defined between the mutual surfaces of the two elements, even when unevenness exists between such surfaces. The sealing rings, interacting with the gas pressure of the gas prevailing in the annular recess, also ensure that molten metal being discharged through the two members does not contact exterior air and thus is not oxidized.

The gas pressure present in the annular recess is controllable by the indicating device. That is, if during use either one of the two sealing rings should form a leak, such leak will be detected by the indicating device as a pressure change. This can result in initiation of necessary maintenance or simply as a warning. In any case, as long as only one of the sealing rings leaks, there still is no danger than the molten metal will make contact with the exterior air. That is, even if one sealing ring fails, the other sealing ring still will provide the necessary sealing function. However, if one sealing ring fails, then there will be a read-out or indication of such fact prior to the occurrence of a condition in which both sealing rings fail or leak. In other words, in accordance with the present invention, it is possible to provide a warning or indication of a potential impending failure of the sealed connection as a whole, but before such total failure occurs. Thereby, it is possible to conduct necessary maintenance before exterior air or oxygen is drawn in through the seat by the discharging molten metal.

Preferably, the compressible sealing rings are formed of refractory ceramic fibrous material. Particular such know materials themselves are known in the art and would be understood by one skilled in the art. The two sealing rings may be connected to one another to form an integral one-piece subassembly. Such connection may be achieved by connecting spacing ribs. The sealing rings or the one-piece subassembly may be mounted in the discharge member before the pipe member is connected to the discharge member, or alternatively may be mounted on the pipe member before the pipe member is connected to the discharge member.

Preferably, the bottom or innermost sealing ring, with respect to the pipe member, abuts a step formed in the pipe member. Thereby it is possible to ensure correct positioning of the sealing rings in a simple manner during assembly.

During operation, particular sealing rings will exhibit a specific gas permeability. However, in accordance with the present invention exterior air will not be drawn therethrough into contact with the molten metal. Rather, the inert gas is supplied to the annular recess and is maintained therein at an excess or positive pressure sufficient to avoid ingress therethrough of exterior air. Particularly, the gas permeability, varying, of the sealing rings will result in a particularly directed gas flow through such sealing rings from the excess gas pressure within the annular recess. This directed gas flow preferably is in the direction into the pipe member, but also can be to the exterior. This can be controlled by regulating or varying the relative gas permeability of the two sealing rings.

BRIEF DESCRIPTION OF THE DRAWINGS

Other objects, features and advantages of the present invention will become apparent from the following detailed description of preferred embodiments thereof, with reference to the accompanying drawings, wherein.

DETAILED DESCRIPTION OF THE INVENTION

Figure 1:
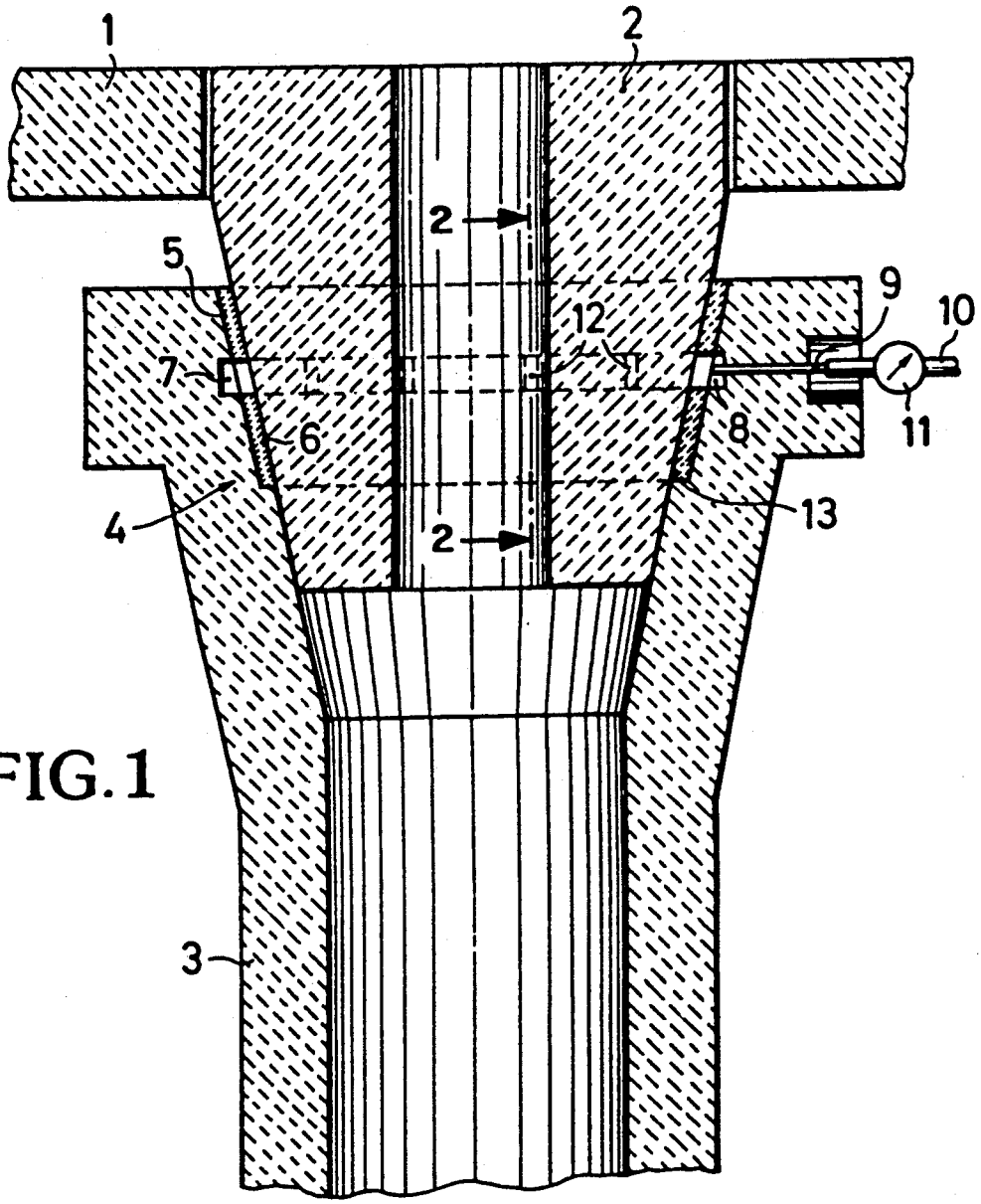
FIG. 1 is a longitudinal sectional view through a discharge spout and an immersion nozzle connected thereto, and incorporating a sealed connection in accordance with an embodiment of the present invention.

In FIG. 1 is shown schematically a bottom 1 of a metallurgical vessel. Extending through an opening in bottom 1 is a conical discharge spout or block 2 of refractory material. Spout 2 has therethrough a discharge opening for the discharge of molten metal. Mounted on spout 2 is a pipe member, in the illustrated embodiment in the form of an immersion nozzle 3 formed of refractory material and having an upper end 4 widened with an internal conical configuration matching that of the exterior of spout 2. Immersion nozzle 3 is connected to spout 2 in a conventional manner, not illustrated and not in and of itself forming the present invention. The outer surface of spout 2 and the inner surface of immersion nozzle 3 form mutually confronting or abutting surfaces defining a seat. In the area of such seat is provided an annular recess 7. A seal is provided to seal this seat, and gas, for example inert gas, is supplied to annular recess 7 through a gas supply line 10 connected to a radially extending channel 9. These features in and o themselves are known.

Figure 2:
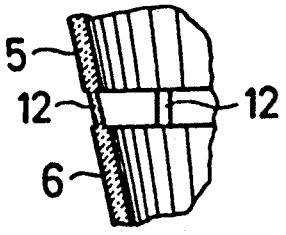
FIG. 2 is an enlarged sectional view of the construction of sealing rings of such sealed connection, taken along line 2—2 in FIG. 1.

In accordance with the present invention however, the seal that seals the seat between the mutual surfaces of the members 2, 3 specifically is provided in the form of a pair of compressible sealing rings 5, 6 that are spaced from each other axially of the members 2, 3 on opposite sides of annular recess 7. As such, annular recess 7 is at least partially defined between the sealing rings 5, 6. Annular recess 7 also can be expanded, for example radially outwardly as illustrated, by an additional annular groove 8 formed in member 3. Sealing rings 5, 6 are compressible and preferably are formed of a refractory ceramic fibrous material. Such materials themselves are known in the art. The sealing rings 5, 6 are connected together by means of spacing ribs 12, shown in more detail in FIG. 2. These spacing ribs extend across or through annular recess 7 without blocking such recess. The two sealing rings 5, 6 and the spacing ribs 12 together may be formed of a ceramic fibrous material as a one-piece integral subassembly. Preferably, the innermost, with regard to member 3, or lower as illustrated, sealing ring 6 sits on or abuts a step 13 defined by a conical axially extending groove formed in the inner surface of member 3.

In additional accordance with the present invention, a pressure indicating device 11 is provided in gas supply line 10. Thus, indicating device 11 provides an indication of the gas pressure prevailing in annular recess 7 by passage of the gas through channel 9 into recess 7.

In accordance with one aspect of the present invention, the immersion nozzle 3 is assembled to the discharge spout 2 in the following manner. Thus, a subassembly including the two spaced compressible sealing rings 5, 6 and the connected spacing ribs 12 is mounted in or pushed into the immersion nozzle 3 until the bottom sealing ring 6 abuts or stands on step 13. Spacing ribs 12 then will be positioned in the region of the groove 8 that expands the annular recess 7. Subsequently, the immersion nozzle 3 and such subassembly mounted thereon is pushed onto the discharge spout 2 and attached thereto in a known manner, not shown. During such assembly and connection, the ceramic fibrous material of sealing rings 5, 6 is compressed. Thereafter, the gas line 10 is connected in a known manner.

During operation, inert gas is supplied to the annular recess 7. Depending upon the particular gas permeability of the sealing rings 5, 6, the degree of compression of sealing rings 5, 6, and the reduced pressure prevailing in immersion nozzle 3 during a casting operation, i.e. during discharge of molten metal, a particular excess pressure will prevail in annular recess 7. This pressure will be indicated by indicating device 11, which in the illustrated arrangement is in the form of a pressure gauge. It of course will be understood that other known pressure indicators and/or transducers may be employed. If one of sealing rings 5, 6 fails such that a gas leak occurs therethrough, then the pressure prevailing in annular recess 7 will fall, and this will be recognized and indicated by device 11. This indication itself is a warning, or indicating device 11 may be of a nature to provide an alarm signal of such pressure drop. This signal or indication in any case is an indication of the possibility of impending failure of the sealed connection a whole, before such total failure actually occurs.

Although the present invention has been described and illustrated with respect to preferred features thereof, it is to be understood that various changes and modifications may be made to the specifically described and illustrated features without departing from the scope of the present invention.

We claim:

1. In an assembly including a discharge member of a metallurgical vessel and a pipe member connected to said discharge member at mutual surfaces thereof defining a seat therebetween, an annular recess formed in the region of said seat, a seal sealing said seat, and means for supplying gas to said annular recess, the improvement comprising:

said seal comprising a pair of compressible sealing rings positioned between said mutual surfaces at locations spaced on opposite sides of said annular recess; and pressure indicator means connected to said gas supplying means for providing an indication of the pressure of gas in said annular recess.

2. The improvement claimed in claim 1, wherein said compressible sealing rings are formed of ceramic fiber material.

3. The improvement claimed in claim 1, wherein said sealing rings are connected together by spacer ribs extending across said annular recess.

4. The improvement claimed in claim 3, wherein said sealing rings and said spacer ribs are formed as an integral one-piece subassembly.

5. The improvement claimed in claim 1, wherein one of said sealing rings axially abuts a step.

6. The improvement claimed in claim 5, wherein said step is formed in said pipe member, and said one sealing ring comprises an innermost sealing ring relative to said pipe member.

7. The improvement claimed in claim 6, wherein said step is defined by an annular groove formed in an inner surface of said pipe member, said sealing rings fit within said annular groove in axially spaced relation to each other, and said annular recess is at least partially defined between said sealing rings.

8. The improvement claimed in claim 7, wherein said annular recess includes a portion formed in said pipe member.

9. The improvement claimed in claim 1, wherein said annular recess is formed in said pipe member.

10. The improvement claimed in claim 1, wherein said discharge member comprises a refractory discharge spout.

11. The improvement claimed in claim 1, wherein said pipe member comprises a protective shielding pipe.

12. The improvement claimed in claim 1, wherein said pipe member comprises a refractory immersion nozzle.

13. The improvement claimed in claim 1, wherein said mutual surfaces defining said seat comprise conical surfaces.

14. A sealing assembly to be form a seal between mutual surfaces of a discharge member of a metallurgical vessel and a pipe member connected thereto, said sealing assembly comprising:

a pair of compressible sealing rings spaced axially of each other; and means connecting said pair of sealing rings to form an integral one-piece assembly.

15. A sealing assembly as claimed in claim 14, wherein said connecting means comprises at least one spacer rib.

16. A sealing assembly as claimed in claim 15, comprising plural said spacer ribs spaced circumferentially of said sealing rings.

17. A sealing assembly as claimed in claim 14, wherein said sealing rings are formed of ceramic fiber material.

18. A method of forming a seal sealing a seat defined between mutual surfaces of a discharge member of a metallurgical vessel and a pipe member connected to said discharge member, said method comprising:

providing an annular recess in the region of said seat and concentric thereto; and positioning between said mutual surfaces a pair of compressible sealing rings at locations spaced on opposite sides of said annular recess.

19. A method as claimed in claim 18, wherein said positioning comprises mounting said sealing rings on said discharge member before said pipe member is connected to said discharge member.

20. A method as claimed in claim 18, wherein said positioning comprises mounting said sealing rings on said pipe member before said pipe member is connected to said discharge member.

21. A method as claimed in claim 18, comprising forming said compressible sealing rings of ceramic fiber material.

22. A method as claimed in claim 18, further comprising connecting said sealing rings together by spacer ribs extending across said annular recess.

23. A method as claimed in claim 22, comprising forming said sealing rings and said spacer ribs as an integral one-piece subassembly.

24. A method as claimed in claim 18, comprising axially abutting one of said sealing rings against a step.

25. A method as claimed in claim 24, comprising forming said step in said pipe member.

26. A method as claimed in claim 25, comprising forming an annular groove in an inner surface of said pipe member to define said step, and fitting said sealing rings within said annular groove in axially spaced relation to each other such that said annular recess is at least partially defined between said sealing rings.

27. A method as claimed in claim 26, comprising partially forming said annular recess in said pipe member.

28. A method as claimed in claim 18, comprising forming said annular recess in said pipe member.

29. A method as claimed in claim 18, further comprising supplying gas to said annular recess, and determining the pressure of said gas in said annular recess.

30. A method as claimed in claim 29, wherein said determining comprises indicating said pressure by a pressure indicator connected to a line for supplying said gas to said annular recess.

31. The improvement claimed in claim 1, wherein said pair of compressible sealing rings are spaced from each other in a direction axially of said annular recess.

32. A method as claimed in claim 18, wherein said pair of compressible sealing rings are spaced from each other in a direction axially of said annular recess.

* * * * *